US011840443B2

(12) United States Patent
Grantham-Hill et al.

(10) Patent No.: US 11,840,443 B2
(45) Date of Patent: Dec. 12, 2023

(54) DRUM EMPTYING STATION

(71) Applicants: Robert George Grantham-Hill, Southwater (GB); Nathan Phillip Atkins, Southwater (GB)

(72) Inventors: Robert George Grantham-Hill, Southwater (GB); Nathan Phillip Atkins, Southwater (GB)

(73) Assignee: Unibloc Hygienic Technologies UK, Ltd.

( * ) Notice: Subject to any disclaimer, the term of this patent is extended or adjusted under 35 U.S.C. 154(b) by 133 days.

(21) Appl. No.: 17/554,007

(22) Filed: Dec. 17, 2021

(65) Prior Publication Data

US 2023/0192471 A1 Jun. 22, 2023

(51) Int. Cl.
*B67D 7/78* (2010.01)
*B67D 7/62* (2010.01)

(52) U.S. Cl.
CPC ..... *B67D 7/78* (2013.01); *B67D 7/62* (2013.01)

(58) Field of Classification Search
CPC . B67D 7/78; B67D 7/62; B67D 7/645; B67D 7/02
USPC ..... 222/83, 83.5; 141/270–280, 7, 65
See application file for complete search history.

(56) References Cited

U.S. PATENT DOCUMENTS 5,005,612 A * 4/1991 Kurtz ..... B41F 31/02 366/195
6,053,219 A * 4/2000 Seiver ..... G01G 17/06 141/83
2010/0236661 A1* 9/2010 Gibisch ..... B67D 7/78 141/279
2021/0309505 A1* 10/2021 Tetley ..... B67D 7/0205

* cited by examiner

*Primary Examiner* — Lien M Ngo
(74) *Attorney, Agent, or Firm* — Miller & Martin PLLC.; Stephen J. Stark

(57) ABSTRACT

A pneumatic drum emptying station locates a lance over an opening in a container. A lance can be inserted into the container to remove material from the container. Pneumatic cylinders may lock a carriage supplying the lance at a desired position along an arm. The arm, rotatable relative to a base post, may be locked in a specific position with pneumatics. Supports may assist in reloading/repositioning containers relative to the base.

18 Claims, 6 Drawing Sheets

DRUM EMPTYING STATION

FIELD OF THE INVENTION

The present invention relates to a drum emptying station, and more particularly, to a drum emptying station configured to empty a tote or multiple drums, such as on a pallet and/or other support, and possibly multi-pallets of drums or other containers utilizing the station in an efficient manner.

BACKGROUND OF THE INVENTION

Merzan, Inc. has been making drum unloading systems for years. The Merzan drum unloading system of FIG. 1 has a lance which is raised and lowered together with an arm connected to a support post. Moving the lance relative to the support post is apparently performed with electronic sensing and relies upon the lifting and lowering of the arm in order to position the lance into a particular drum. The lance does not move independently of the arm.

While this technology is certainly effective for some applications, clearance above the drum is required of a sufficient height for the complete length of the arm for the arm together with the height of the drums so as to permit the positioning of the lance above a specific drum. The lance is connected at the bottom of the arm on a carriage which permits the lance to move linerally along the arm. Still other applications may not be able to use electricity due to fire or other concerns.

Improvements over the prior art unloading system are believed to be desirable in the marketplace.

SUMMARY OF THE INVENTION

It is a present object of many embodiments of the present invention to provide a pneumatic system for pumping if not also moving or controlling the movement of a suction lance relative to various drums or other containers as well as possibly the lifting and lowering of the lance, preferably independently relative to the arm and carriage on which it may be positioned.

It is another object of many embodiments of the present invention is to provide an unloading station with a lance which lowers and raises relative to a carriage on an arm in and out of a desired container for use in removing material from that container.

Accordingly, in accordance with a presently preferred embodiment of the present invention, an unloading station is provided having a base support with a cantileveredly extending arm extending from the base support. The arm is operably coupled to the base support such as pivoting relative to the base support so as to position a lance coupled to a carriage, which is moveable linerally along the arm above an opening in a container. At least a portion of the carriage may be located above a specific container form which materials may be removed by the lance.

The lance raises and lowers relative at the carriage into the container. The lance is preferably connected at an upper end, or outlet port, of the lance to a piping system having a pump, such as a pneumatic pump, to direct material from the drum or other container to further processing location(s).

Materials such as tomato paste, chemicals, lotions, various fluids or other materials may be pumped out in an efficient manner to reduce the manual effort often employed with the unloading of drums.

The lance may be lowered into a drum (or other container) to any of a variety of depths and the pump turned on to begin emptying the drum. Once the drum is empty (or a sufficient amount of material removed, the lance may be raised and repositioned over another drum or other container to repeat the process. The lance may be cleaned between different material such as with a clean in place system. Once the containers are empty or under various other conditions, a different container may be selected to start the emptying process, the containers may be removed and the station may be reloaded as appropriate.

The unloading station of the applicant may be more compact at the base support than prior art configurations. The unloading station is also believed to rely upon pneumatic controls rather than electric sensors used in prior art systems. Pneumatic cylinders may act as brakes to hold the arm at a desired place relative to the base support as well as the carriage relative to the arm and possibly assist in the raising and/or lowering of the lance. The "brakes" may be employed as a safety feature to be applied until released to reposition the arm and/or release the lance to lower into a container for at least some embodiments.

The pump can automatically engage when the lance is fully lowered in some embodiments. Other embodiments may employ a separate "Pump On" button to start the pump. An "end cycle" button could be activated to raise the lance possibly while automatically stopping the pump. Separate or other control(s) of the pump could be provided with other embodiments. A clean in place (CIP) station may be provided to assist in cleaning the lance and possibly downstream piping.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
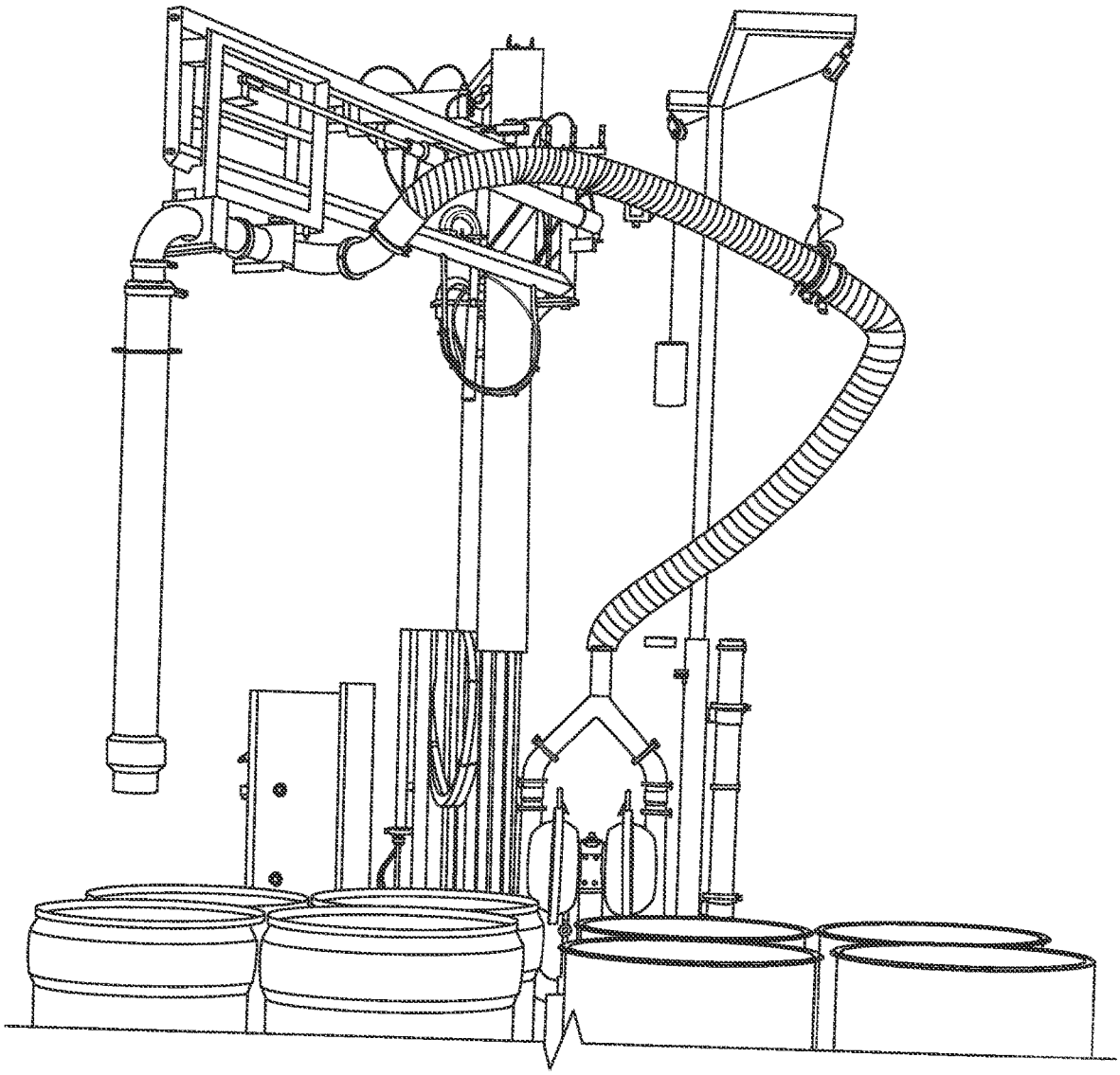
FIG. 1 (Prior Art)
FIG. 1 is a prior art drum unloading station.
Figure 2:
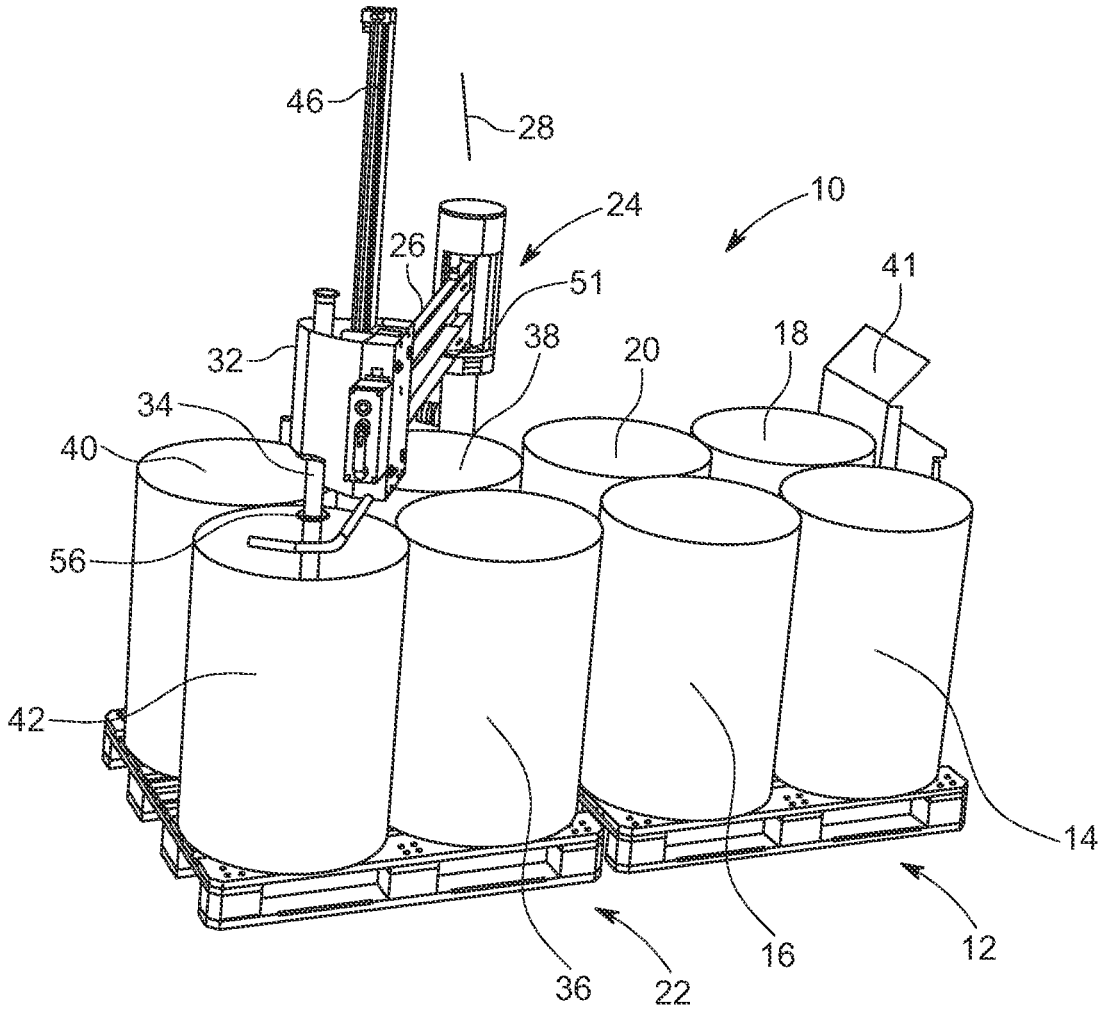
FIG. 2 is a front perspective view of the presently preferred embodiment of the present invention with the pump removed.

FIG. 1 shows a drum emptying station 10 of a presently preferred embodiment of the present invention. The station 10 can accommodate a pallet 12 of drums 14,16,18,20 or multiple pallets such as first pallet 12 and second pallet 22. Other embodiments may accommodate totes or other containers as will be explained in further detail below.

Figure 3:
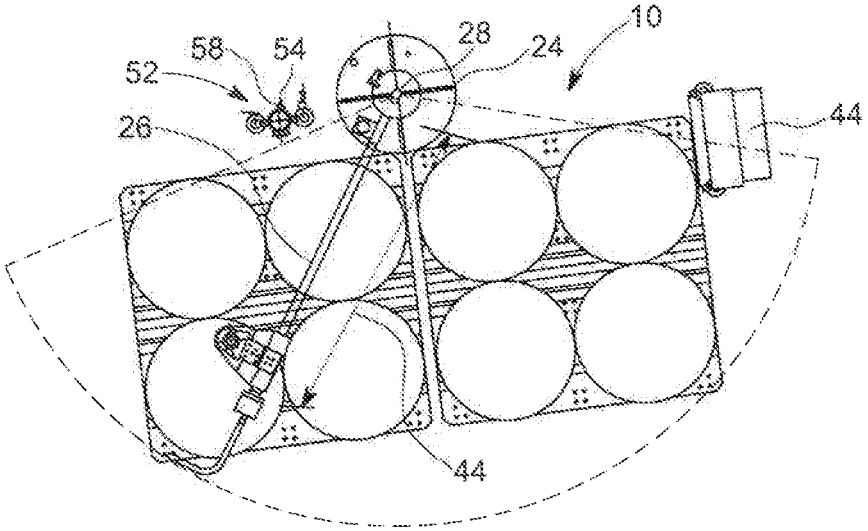
FIG. 3 is a top plan view of the embodiment of FIG. 1.
Figure 4:
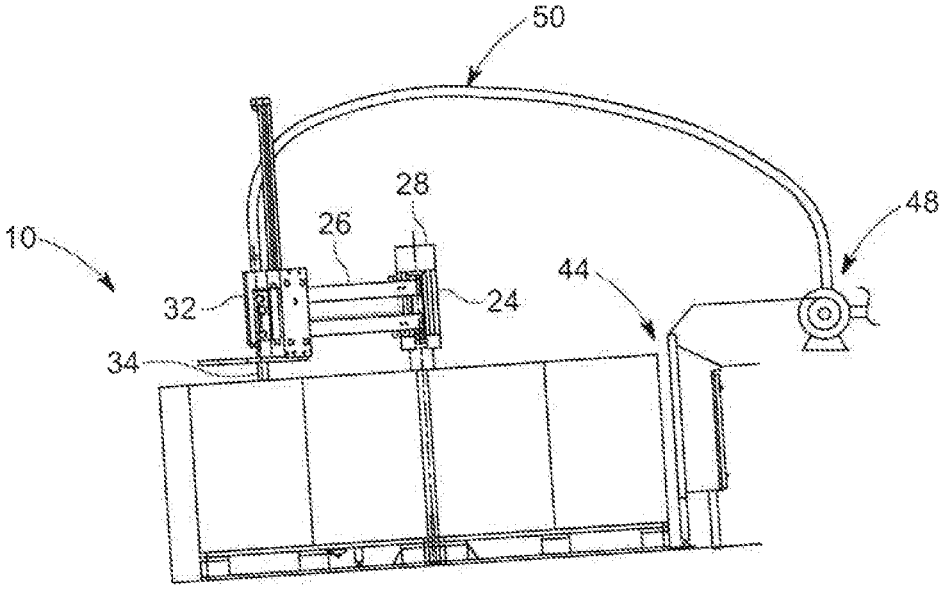
FIG. 4 is a side plan view of the embodiment of FIG. 1.

The station 10 has a base post 24 which, preferably, cantileverdly supports an arm 26 which may selectively rotate relative to base post 24 such as along axis 28. The arc of rotation of the arm 26 relative to the base post 24 may be as shown in FIG. 3 or otherwise provided. In this embodiment about 150 degrees of rotation, possibly up to a maximum of 180 degrees or other amount, is provided so as to be able to position a carriage 32 and its lance 34 over a specific drum 14,16,18,20,36,38,40,42 etc. Other embodiments may rotate through a different arc for various applications, With the carriage in the desired position, pneumatic controls such as at controller 44 may be employed to pneumatically lock the rotation of the arm 26 relative to the base post 24 in its desired angular position as possibly with a first pneumatic cylinder (internal to base post 24 in this embodiment) while also potentially securing the carriage 32 at a specific linear location along a length 44 of the arm 26 with a second pneumatic cylinder 51. This preferably locates the lance 34 directly above an opening into at least one of the containers 14-20,36-42 etc. The lance 34 can then either be pneumatically positioned such as using third pneumatic cylinder 46 or otherwise to lower the lance 34 into a specific one of the containers illustrated as drums 14-20,36-42, etc. to a desired depth up to fully lowered. If the brake is released (release of hold by third pneumatic cylinder 46), compressed air may move the lance 34 into the desired position. It may be that pump 48 is engaged, possibly automatically, at a specific position of the lance 34 such as at a fully lowered position. The length 44 of the arm 26 may be sufficiently long enough when rotated through the arc about the axis 28 so as to be able to empty eight drums with four drums per pallet 12,22. Other embodiments may be constructed differently.

One of ordinary skill in the art will observe that the support or base post 24 is not significantly, if any, higher than the carriage 32, which preferably does not move elevationally (just linearly along the arm 26 for many embodiments). This means that with this construction, the arm 26 does not raise and lower but instead is maintained at approximately the same horizontal location or the same elevation above the various containers to which it is employed to assist in emptying at the station 10.

Additionally, the applicant's preferred embodiments utilize no electricity so there is no fire or explosion hazard possibly at the station 10 from an inadvertent spark of an electrical nature for at least some embodiments. The cylinders, such as second cylinder 51 or third cylinder 46 and first cylinder (internal to base post 24), may be controlled by the controller 44 possibly along with the pump 48. The clean in place station 52 can also be operated pneumatically from the controller 44 in an effort to promote safety and/or cleanliness by the user. When utilizing the clean in place station 52, a scabbard 58 is provided to receive the lance 34. The lance 34 may be positioned above the receiver or scabbard 54. The lance 34 may then be lowered possibly pneumatically, with gravity, or manually, into the scabbard 54. Mating ferrules such as tri-clamp ferrules 56,58 may be clamped together to secure the lance 34 to the scabbard 58. Cleaning the interior and exterior of the lance 34 at the cleaning place station 52 may utilize the user's protocols. Those protocols may also result in the cleaning of the pipe and pump 48 and possibly downstream piping 50 as well. The ferrules 56,58 may be released to release the lance 34 from the scabbard 58 so that the lance 34 may be raised out of the scabbard 54 to be ready to be reutilized.

Figure 5:
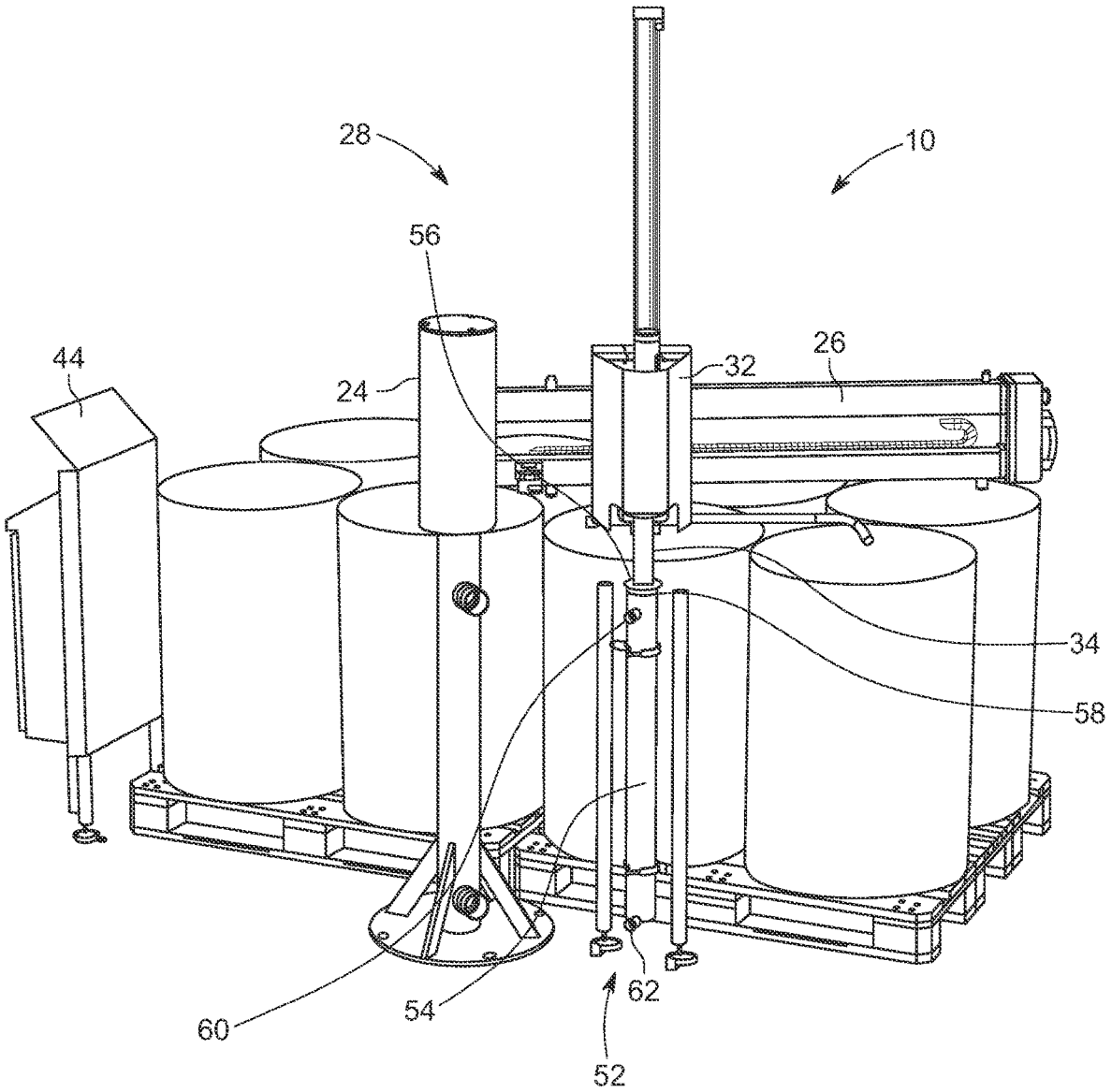
FIG. 5 is a rear perspective view of the embodiment of FIG. 1.

Controller 44 may be utilized to secure the angular position of the arm 26 at a desired specific position. The controller 44 or another mechanism, such as a button on the end of the arm 26 may utilized to move the carriage 32 to a desired position along the arm 26 so that the lance 34 is effectively locked into position during the cleaning procedure with some embodiments. FIG. 5 shows the lance 34 secured to the scabbard 58. For such a procedure with connections 60,62 are available to direct fluid thereto and therefrom to assist in cleaning the lance 34 at the clean in place station 52.

The embodiment of FIGS. 2-5 are particularly effective for removing material from drums 14-20 and 36-42 or other containers on a support such as pallets 12,22, a conveyor (see FIG. 7) a turntable (FIG. 6) or any combination thereof. Other systems may incorporate this technology and others.

Figure 6:
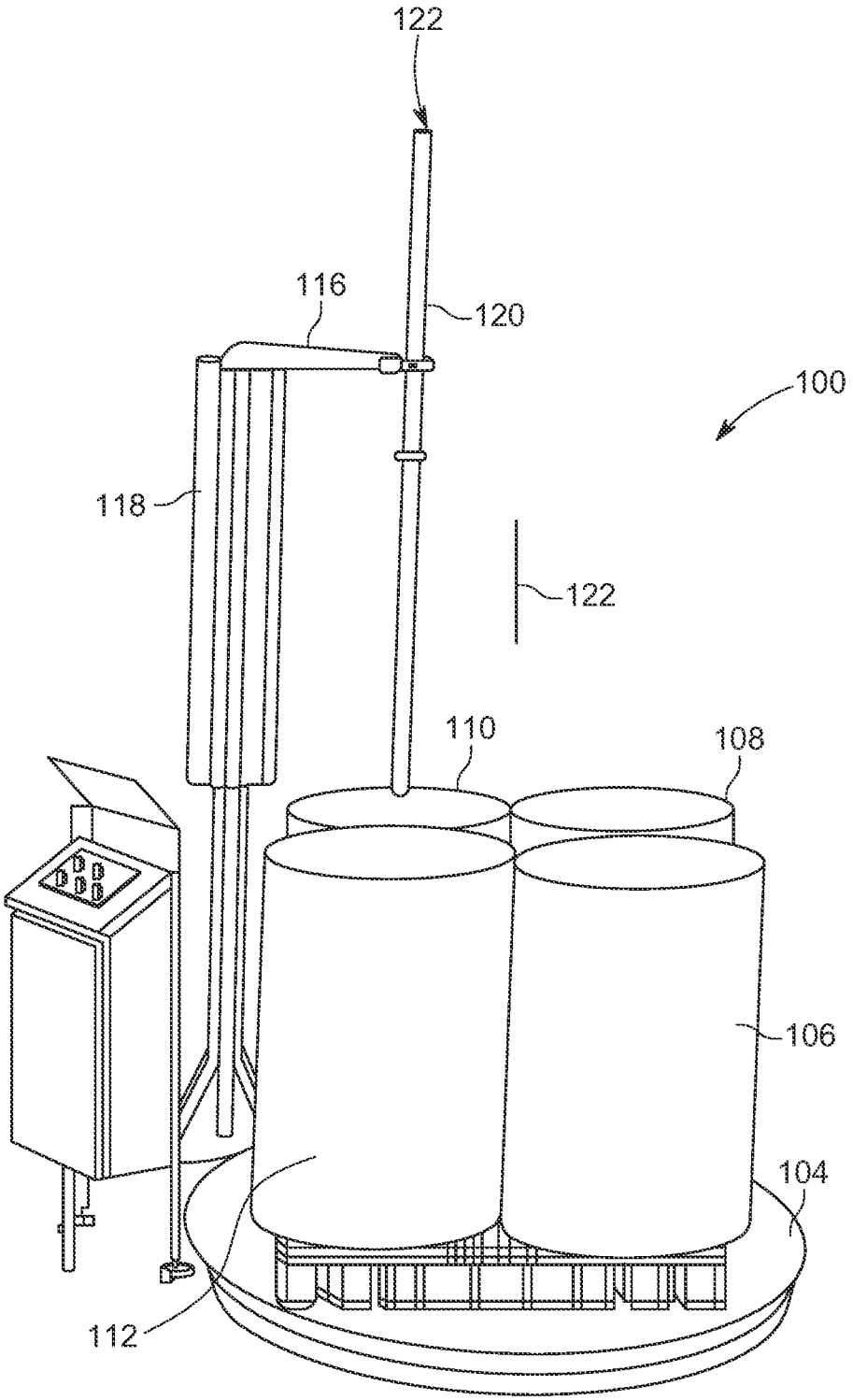
FIG. 6 is the first alternative embodiment.

FIG. 6 shows an embodiment of an alternatively preferred station 100 having a turntable 102 onto which a pallet 104 is place possibly with four drums 106,108,110,112. In this embodiment the arm 116 may be fixably mounted to post 118 and the lance 120 may be selectively raised or lowered relative to any of the containers 106,112 as positioned by use of the turntable 102 below the lance 120. Although pneumatic raising and lowering of the lance 120 relative to the arm 116 are not shown in this embodiment those features may be employed from the embodiment of FIGS. 2-5 and still further embodiments. Also, the piping 50 and pump 48 from FIG. 4 would be attached at end, or outlet port 122 of lance 120 as understood by those of ordinary skill in the art. Turntable 102 may rotate about axis 122 to position a selected container (such as drums 106,108,110,112) below the lance 118.

Figure 7:
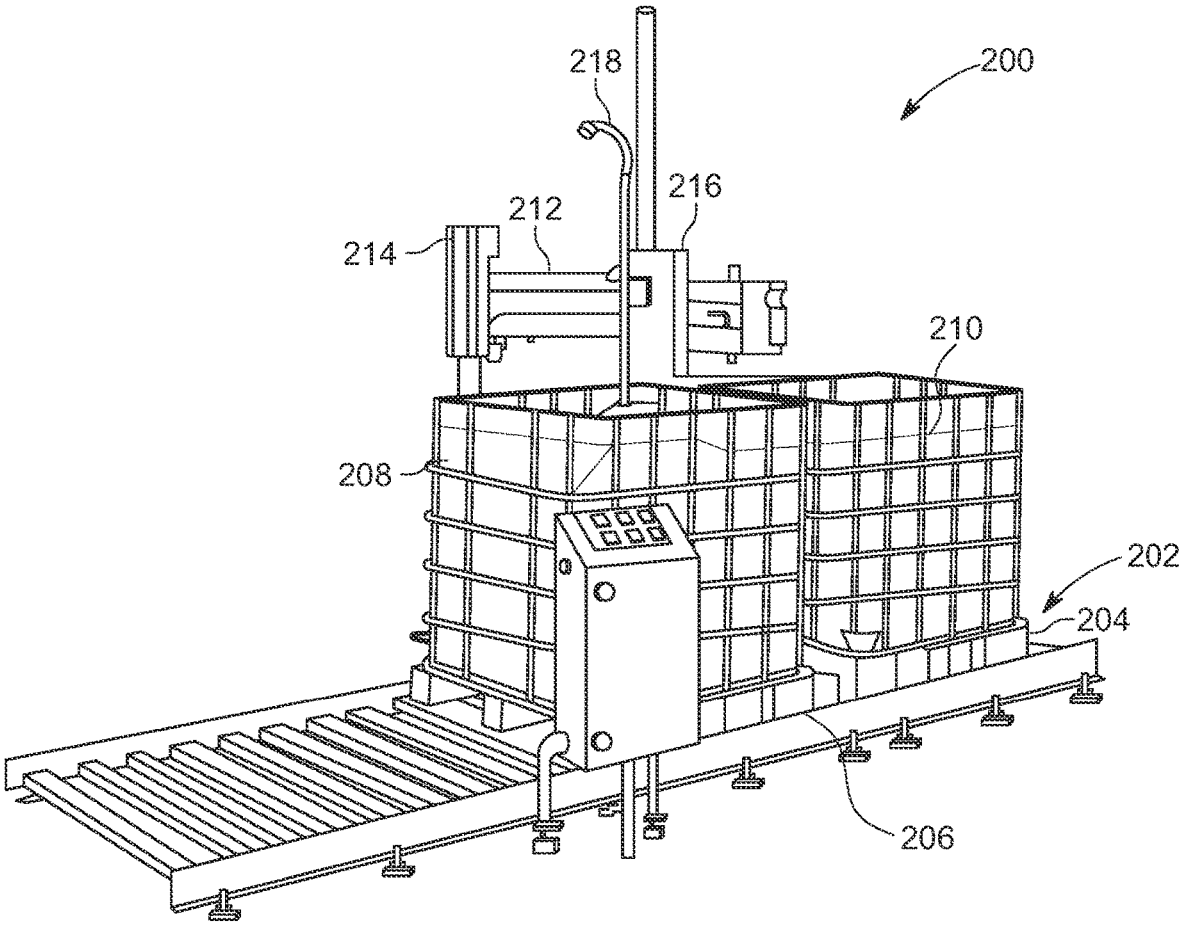
FIG. 7 is a side perspective view of a second alternative preferred embodiment.

FIG. 7 shows still another embodiment in the form of a station 200 having a conveyor 202 onto which a pallet 204,206 are illustrated, this time with totes 208,210 as containers although certainly drums or other containers could be provided as well. In this station 200, the arm 212 may or may not rotate relative to support post 214 and depending on the particular embodiment, the carriage 216 may be fixably connected to the arm 212 as well so with just an ability to raise or lower the lance 218 relative to the arm 212 (either manually and/or with pneumatic assistance). Of course, in order to be more versatile, it may be that the arm 212 rotates relative to the base post 214 as shown in the FIGS. 2-5 and the carriage 216 moves linerally along the arm 212 in a similar manner as that embodiment. Once again, the controller 220 may be useful to lock the position of the carriage 216 relative to the arm as well as the arm 212 relative to the base post 214 as well as potentially raise and/or lower the lance 218 into a specific container such as totes 208,218 as illustrated while possibly also directly or indirectly engage the pump (not shown in FIG. 7) to operate to therefore begin moving material from the containers as illustrated as totes 208,210 etc.

Many embodiments of stations 10,100,200 may rely strictly on pneumatics with an absence of electronics so as to remove potential fire hazards under certain conditions. This particular design is particularly modular and adaptable to various environments to provide a cost effective drum emptying station for many uses whether it be industrial, food, or other environment. Difficult manual labor can be eliminated utilizing the various stations illustrated herein.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed is:

1. A container unloading station comprising:

a support base;

an arm cantileverdly connected to the support base at a pivot at a predetermined elevation;

a carriage linearly movable along a length of the arm to a selected position;

a lance selectively movable vertically relative to the carriage to at least a raised and a lowered position; and piping directing an outlet port of the lance to a pump, wherein upon activation of the pump, said pump draws a suction through the lance sucking contents from a container into which the lance is inserted below the carriage; and wherein the station operates independently of electrical signals and the lance has an outlet port extending above the carriage in the raised position.

2. The container unloading station of claim 1 further comprising a support, said support supporting the container thereon from below the lance.

3. The container unloading station of claim 2 wherein a pallet is located between the container and the support.

4. The container unloading station of claim 2 wherein the support is a pallet.

5. The container unloading station of claim 3 wherein the support is a conveyor, said conveyor linearly moving the container.

6. The container unloading station of claim 3 wherein the support is a turntable, said turntable rotating the container about an axis.

7. A container unloading station comprising:

a support base;

an arm cantileverdly connected to the support base at a pivot at a predetermined elevation;

a carriage linearly movable along a length of the arm to a selected position;

a lance selectively movable vertically relative to the carriage to at least a raised and a lowered position;

piping directing an outlet port of the lance to a pump, wherein upon activation of the pump, said pump draws a suction through the lance sucking contents from a container into which the lance is inserted below the carriage; and a clean in place station having a scabbard, said scabbard selectively receiving the lance therein.

8. The container unloading station of claim 7 wherein the lance and the scabbard have mating ferrules which assist in locking the lance to the scabbard in a cleaning configuration.

9. The container unloading station of claim 7 having at least one fluid connection communicating fluid into the scabbard.

10. The container unloading station of claim 9 having at least two fluid connections communicating fluid into the scabbard.

11. The container unloading station of claim 1 wherein upon lowering the lance to the lowered position, the pump automatically starts pumping.

12. The container unloading station of claim 11 further comprising a pneumatic controller which at least releases the lance to move toward the lowered position from the raised position.

13. The container unloading station of claim 12 wherein the pneumatic controller has an "end pumping" configuration wherein upon activation of the end pumping configuration, the lance is pneumatically raised to the raised position while automatically stopping the pump.

14. A container unloading station comprising:

a support base;

an arm cantileverdly connected to the support base at a predetermined elevation;

a carriage linearly movable along a length of the arm to a selected position;

a lance selectively movable vertically relative to the carriage between a raised and a lowered position, said lance having an outlet port extending above the arm in the raised position;

piping directing an end of the lance to a pump, wherein upon activation of the pump, said pump draws a suction through the lance sucking contents from a container into which the lance is inserted below the carriage; and a pneumatic controller wherein the controller has a release configuration permitting the arm to pivot relative to the support base and the carriage to move along the arm and a locked confiuration locking the rotation of the arm relative to the support base and locking the carriage from linear movement relative to the arm.

15. The container unloading station of claim 14 further comprising a support below the container.

16. The container unloading station of claim 14 wherein the support is a conveyor.

17. A container unloading station comprising:

a support base;

an arm cantileverdly connected to the support base at a predetermined elevation;

a carriage located along a length of the arm at a selected position;

a lance selectively movable vertically relative to the carriage between a raised and a lowered position, said lance having an outlet port extending above the arm in the raised position;

piping directing the outlet port of the lance to a pump, wherein upon activation of the pump, said pump draws a suction through the lance sucking contents from a container into which the lance is inserted below the carriage; and a support located below the container with the support having a turntable rotatable about an axis to selectively position the container below the lance.

18. The container unloading station of claim 17 wherein the support further comprises a pallet and the pallet has a plurality of containers thereon.

* * * * *